US011854493B2

(12) United States Patent
Zhao et al.

(10) Patent No.: US 11,854,493 B2
(45) Date of Patent: Dec. 26, 2023

(54) DISPLAY SUBSTRATE AND DISPLAY DEVICE

(71) Applicant: BOE TECHNOLOGY GROUP CO., LTD., Beijing (CN)

(72) Inventors: Jiao Zhao, Beijing (CN); Li Xiao, Beijing (CN); Minghua Xuan, Beijing (CN); Haoliang Zheng, Beijing (CN); Dongni Liu, Beijing (CN); Jing Liu, Beijing (CN); Qi Qi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 417 days.

(21) Appl. No.: 17/052,526

(22) PCT Filed: Nov. 27, 2019

(86) PCT No.: PCT/CN2019/121249
§ 371 (c)(1),
(2) Date: Nov. 2, 2020

(87) PCT Pub. No.: WO2021/102734
PCT Pub. Date: Jun. 3, 2021

(65) Prior Publication Data

US 2023/0113488 A1 Apr. 13, 2023

(51) Int. Cl.
*G09G 3/3291* (2016.01)

(52) U.S. Cl.
CPC ... *G09G 3/3291* (2013.01); *G09G 2300/0426* (2013.01); *G09G 2310/0286* (2013.01); *G09G 2330/06* (2013.01); *G09G 2330/08* (2013.01)

(58) Field of Classification Search
CPC ..... G09G 3/3291; G09G 2300/0426; G09G 2310/0286; G09G 2330/06; G09G 2330/08
See application file for complete search history.

(56) References Cited

U.S. PATENT DOCUMENTS

2017/0047034 A1* 2/2017 Nishiyama ..... G09G 3/3688
2018/0138256 A1* 5/2018 Han ..... G09G 3/3275
(Continued)

FOREIGN PATENT DOCUMENTS

CN 104409065 A 3/2015
CN 108140350 A 6/2018
(Continued)

OTHER PUBLICATIONS

Extended Search Report dated Dec. 16, 2022 issued in corresponding European Application No. 19945454.7.
(Continued)

*Primary Examiner* — Kenneth B Lee, Jr.
(74) *Attorney, Agent, or Firm* — Nath, Goldberg & Meyer; Joshua B. Goldberg

(57) ABSTRACT

The present disclosure provides a display substrate and a display device, and belongs to the field of display technology. The display substrate of the present disclosure includes: a base substrate; and a plurality of pixel units arranged in an array, a plurality of signal lines and signal supply modules on the base substrate; wherein the signal supply module includes: a signal supply circuit and a redundant signal supply circuit; each of the signal supply modules is electrically coupled to at least one of the plurality of pixel units through at least one of the plurality of signal lines.

20 Claims, 6 Drawing Sheets

(56) References Cited

U.S. PATENT DOCUMENTS

| | | | | |
|---|---|---|---|---|
| 2018/0191978 | A1* | 7/2018 | Cok | H04N 25/74 |
| 2018/0211582 | A1* | 7/2018 | Sakariya | G09G 3/2088 |
| 2018/0286300 | A1 | 10/2018 | Vahid Far et al. | |
| 2019/0088190 | A1* | 3/2019 | Zhang | G09G 3/20 |
| 2019/0295466 | A1 | 9/2019 | Park et al. | |
| 2019/0326751 | A1 | 10/2019 | Xi | |

FOREIGN PATENT DOCUMENTS

| | | | |
|---|---|---|---|
| CN | 108962160 | A | 12/2018 |
| EP | 3321920 | A2 | 5/2018 |
| JP | 2009008891 | A | 1/2009 |
| JP | 2010217344 | A | 9/2010 |
| JP | 2011008278 | A | 1/2011 |
| WO | 2010035785 | A1 | 4/2010 |
| WO | 2010035792 | A1 | 4/2010 |

OTHER PUBLICATIONS

Office action dated Aug. 23, 2023, for JP patent application 2021-572042 with English translation.

* cited by examiner

DISPLAY SUBSTRATE AND DISPLAY DEVICE

CROSS-REFERENCE TO RELATED APPLICATION

This is a National Phase Application filed under 35 U.S.C. 371 as a national stage of PCT/CN2019/121249, filed on Nov. 27, 2019, the content of which is hereby incorporated by reference in its entirety.

TECHNICAL FIELD

The present disclosure belongs to the field of display technology, and particularly relates to a display substrate and a display device.

BACKGROUND

The micro inorganic light emitting diode technology is a new generation display technology, and has higher brightness, better luminous efficiency and lower power consumption compared with the existing OLED technology. However, since the manufacturing process of a micro inorganic light emitting diode display substrate is complicated, and micro inorganic light emitting diodes are formed on the display substrate by a transfer printing method, a large electrostatic discharge (ESD) occurs in the manufacturing process of the micro inorganic light emitting diode display substrate, and how to reduce the ESD is an urgent technical problem to be solved.

SUMMARY

The present disclosure is directed to at least one of the problems in the related art, and provides a display substrate and a display device.

In a first aspect, an embodiment of the present invention provides a display substrate, which includes:

a base substrate; and a plurality of pixel units arranged in an array, a plurality of signal lines and signal supply modules on the base substrate;

wherein the signal supply module includes: a signal supply circuit and a redundant signal supply circuit; and each of the signal supply modules is electrically coupled to at least one of the plurality of pixel units through at least one of the plurality of signal lines.

In an embodiment, the signal supply circuit and the redundant signal supply circuit of each signal supply module are electrically coupled to at least one of the plurality of pixel units through at least one of the plurality of signal lines.

In an embodiment, each of the plurality of pixel units includes a plurality of sub-pixels; the plurality of signal lines include data line groups, and each of the data line groups includes a plurality of data lines; pixel units in a same column are coupled with a same data line group, sub-pixels in a same column are coupled with a same data line, and sub-pixels in different columns are coupled with different data lines;

the signal supply modules and the data line groups are in one-to-one correspondence;

the signal supply circuit includes: a first data selector; the redundant signal supply circuit includes: a second data selector; and the first data selector and the second data selector of each of the signal supply modules are electrically coupled to pixel units through the data line group corresponding thereto.

In an embodiment, the display substrate further includes: a data voltage introduction line, a first electrostatic ring structure and a second electrostatic ring structure;

the data voltage introduction line is coupled with the first data selector through the first electrostatic ring structure; a first protection resistor is coupled between the data voltage introduction line and the first electrostatic ring structure; a second protection resistor is coupled between the first electrostatic ring structure and the first data selector;

the data voltage introduction line is coupled with the second data selector through the second electrostatic ring structure; a third protection resistor is coupled between the data voltage introduction line and the second electrostatic ring structure; a fourth protection resistor is coupled between the second electrostatic ring structure and the second data selector.

In an embodiment, each of the first electrostatic ring structure and the second electrostatic ring structure includes a first electrostatic transistor, a second electrostatic transistor, a third electrostatic transistor and a fourth electrostatic transistor;

a first electrode of the first electrostatic transistor is coupled with a control electrode thereof and the data voltage introduction line, a second electrode of the first electrostatic transistor is coupled with a first electrode and a control electrode of the second electrostatic transistor, and a second electrode of the second electrostatic transistor is coupled with a non-working level signal terminal; and a first electrode of the third electrostatic transistor is coupled with the data voltage introduction line, a second electrode of the third electrostatic transistor is coupled with a control electrode thereof and a first electrode of the fourth electrostatic transistor, and a second electrode of the fourth electrostatic transistor is coupled with a control electrode thereof and a working level signal terminal.

In an embodiment, resistance values of the first protection resistor, the second protection resistor, the third protection resistor and the fourth protection resistor are all between 400Ω and 500Ω.

In an embodiment, the pixel unit includes three sub-pixels; the data line group includes three data lines.

In an embodiment, the first data selector and the second data selector are on a side of the base substrate where signal input terminals of the data lines are located.

In an embodiment, the signal lines include gate lines; the pixel units in a same row are coupled with a same gate line; the signal supply circuit of each of the signal supply modules includes a first shift register, and the redundant signal supply circuit includes a second shift register; the first shift register and the second shift register are arranged in pairs and coupled to a same gate line; and the gate line is coupled with the first shift register and the second shift register in pairs in at least one of the signal supply modules.

In an embodiment, the gate line is coupled with two signal supply modules, and the two signal supply modules are coupled to two opposite ends of the gate line, respectively.

In an embodiment, in the signal supply modules, a plurality of first shift registers are coupled in cascade, and a plurality of second shift registers are coupled in cascade;

stages of first shift registers are respectively coupled with different gate lines; stages of second shift registers are respectively coupled with different gate lines;

a signal input terminal of an N-th stage of first shift register is coupled with a signal output terminal of an (N−1)-th stage of first shift register; a signal output terminal of the N-th stage of first shift register is coupled with a signal input terminal of an (N+1)-th stage of first shift register; and a signal input terminal of an N-th stage of second shift register is coupled with a signal output terminal of an (N−1)-th stage of second shift register; a signal output terminal of the Nt-h stage of second shift register is coupled with a signal input terminal of an (N+1)-th stage of second shift register, where N is an integer greater than 1.

In an embodiment, only one of the signal supply circuit and the redundant signal supply circuit of each of the signal supply modules is electrically coupled to at least one of the plurality of pixel units through at least one of the plurality of signal lines.

In an embodiment, each of the plurality of pixel units includes a plurality of sub-pixels; the plurality of signal lines include data line groups, and each of the data line groups includes a plurality of data lines; pixel units in a same column are coupled with a same data line group, sub-pixels in a same column are coupled with a same data line, and sub-pixels in different columns are coupled with different data lines;

the signal supply modules and the data line groups are in one-to-one correspondence;

the signal supply circuit includes: a first data selector; the redundant signal supply circuit includes: a second data selector; and only one of the first data selector and the second data selector of each of the signal supply modules is electrically coupled to the pixel units through the data line group corresponding thereto.

In an embodiment, the display substrate further includes: a data voltage introduction line, a first electrostatic ring structure and a second electrostatic ring structure;

the data voltage introduction line is coupled with the first data selector through the first electrostatic ring structure; a first protection resistor is coupled between the data voltage introduction line and the first electrostatic ring structure; a second protection resistor is coupled between the first electrostatic ring structure and the first data selector; and the data voltage introduction line is coupled with the second data selector through the second electrostatic ring structure; a third protection resistor is coupled between the data voltage introduction line and the second electrostatic ring structure; a fourth protection resistor is coupled between the second electrostatic ring structure and the second data selector.

In an embodiment, each of the first electrostatic ring structure and the second electrostatic ring structure includes a first electrostatic transistor, a second electrostatic transistor, a third electrostatic transistor and a fourth electrostatic transistor;

a first electrode of the first electrostatic transistor is coupled with a control electrode thereof and the data voltage introduction line, a second electrode of the first electrostatic transistor is coupled with a first electrode and a control electrode of the second electrostatic transistor, and a second electrode of the second electrostatic transistor is coupled with a non-working level signal terminal; and a first electrode of the third electrostatic transistor is coupled with the data voltage introduction line, a second electrode of the third electrostatic transistor is coupled with a control electrode thereof and a first electrode of the fourth electrostatic transistor, and a second electrode of the fourth electrostatic transistor is coupled with a control electrode thereof and a working level signal terminal.

In an embodiment, the first data selector and the second data selector are on a side of the base substrate where signal input terminals of the data lines are located.

In an embodiment, the signal lines include gate lines; pixel units in a same row are coupled with a same gate line; the signal supply circuit of each of the signal supply modules includes a first shift register, and the redundant signal supply circuit includes a second shift register; the first shift register and the second shift register are arranged in pairs and correspond to a same gate line; and the gate line is coupled with only one of the first shift register and the second shift register in pairs in at least one of the signal supply modules.

In an embodiment, the gate line is coupled with two signal supply modules, and the two signal supply modules are coupled to two opposite ends of the gate line, respectively.

In an embodiment, in the signal supply modules, a plurality of first shift registers are coupled in cascade, and a plurality of second shift registers are coupled in cascade; stages of first shift registers are respectively coupled with different gate lines; stages of second shift registers are respectively coupled with different gate lines;

a signal input terminal of an N-th stage of first shift register is coupled with a signal output terminal of a (N−1)-th stage of first shift register; a signal output terminal of the N-th stage of first shift register is coupled with a signal input terminal of an (N+1)-th stage of first shift register; and a signal input terminal of an N-th stage of second shift register is coupled with a signal output terminal of an (N−1)-th stage of second shift register; a signal output terminal of the N-th stage of second shift register is coupled with a signal input terminal of an (N+1)-th stage of second shift register.

In an embodiment, the pixel unit includes a light emitting device; the light emitting device includes: a micro inorganic light emitting diode.

In a third aspect, an embodiment of the present invention provides a display panel, which includes the display substrate described above.

DETAILED DESCRIPTION

In order that those skilled in the art can better understand technical solutions of the present disclosure, the present disclosure will be further described in detail below with reference to the accompanying drawings and specific implementations.

Unless defined otherwise, technical or scientific terms used herein shall have their ordinary meanings as understood by one of ordinary skill in the art to which this disclosure belongs. The use of "first," "second," and the like in this disclosure is not intended to indicate any order, quantity, or importance, but is used to distinguish one element from another. Also, the use of the terms "a," "an", "the", and the like does not denote a limitation of quantity, but denotes the presence of at least one. The word "comprise", "include", or the like, means that the element or item preceding the word includes the element or item listed after the word and its equivalent, but does not exclude other elements or items. The terms "connect" or "couple" and the like are not restricted to physical or mechanical connections, but may include electrical connections, whether direct or indirect. Words "upper", "lower", "left", "right", and the like are used only to indicate relative positional relationships, and when the absolute position of the object being described is changed, the relative positional relationships may also be changed accordingly.

Figure 1:
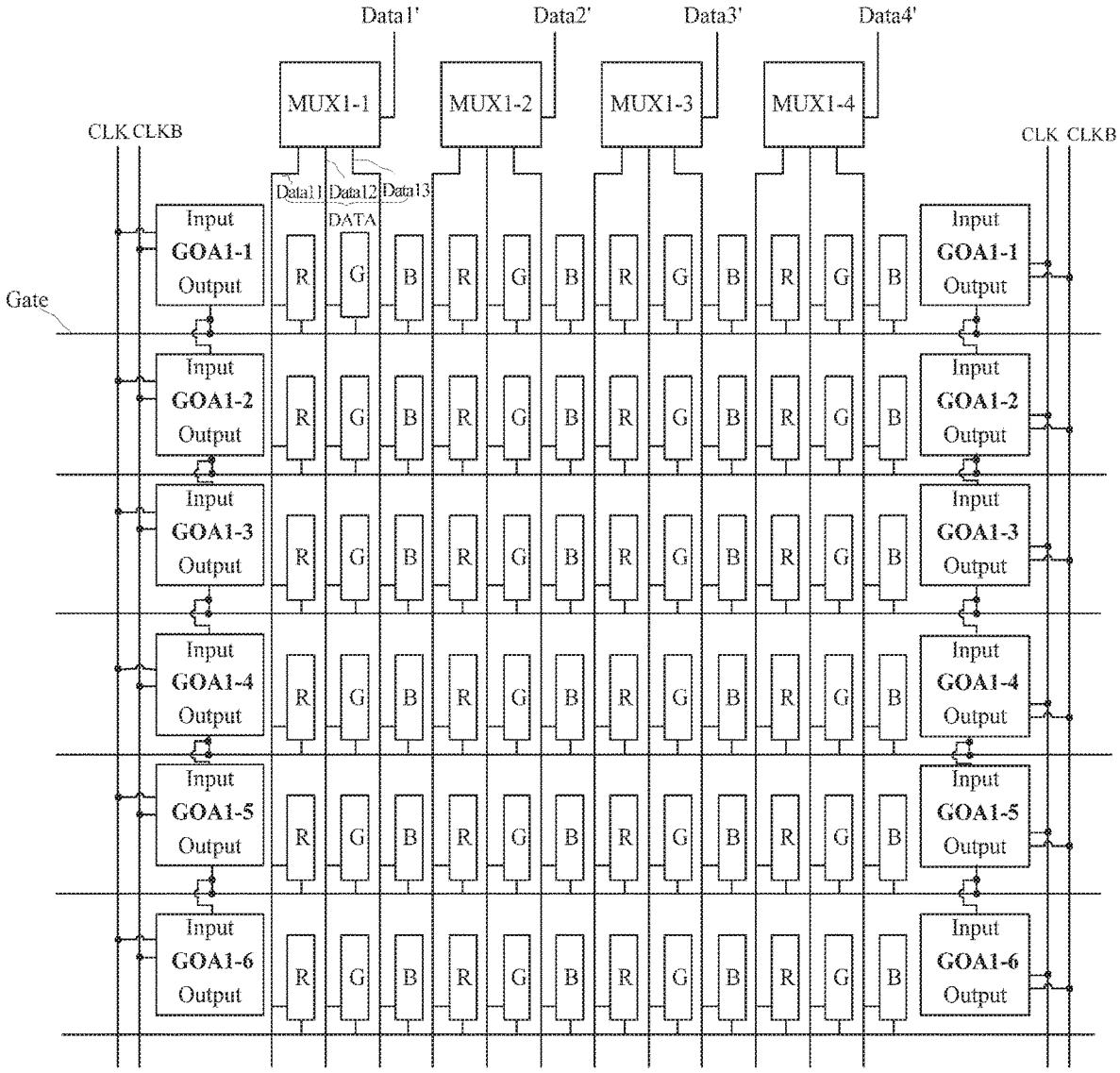
FIG. 1 is a schematic diagram of an existing display substrate.

As shown in FIG. 1, in the display substrate according to an embodiment of the present disclosure, pixel units may be arranged in an array; each pixel unit may include three sub-pixels having different colors; for example, each pixel unit may include a red sub-pixel R, a green sub-pixel G and a blue sub-pixel B. It should be noted that, in the embodiment of the present disclosure, the color of each sub-pixel may be determined according to a color of light emitted by a light emitting device in the sub-pixel; for example: if the light emitted by the light emitting device in the sub-pixel is red light, the sub-pixel is called a red sub-pixel R. Of course, if colors of light emitted by the light emitting devices in the display substrate are all the same, for example, light emitted by every light emitting device is white light, the color of each sub-pixel is determined according to a color of a color filter in a color filter substrate, which is disposed opposite to the display substrate, in the display panel using the display substrate; for example: if the color of the color filter on the color filter substrate corresponding to a sub-pixel is red, the sub-pixel is called a red sub-pixel R.

As shown in FIG. 1, a specific structure of an exemplary display substrate is given; the display substrate includes a plurality of data lines Data extending in a column direction and a plurality of gate lines Gate extending in a row direction, the plurality of gate lines Gate and the plurality of data lines Data crossing over each other, and sub-pixels are defined at crossing points; sub-pixels in a same column has a same color, every three adjacent sub-pixels in the row direction form one pixel unit, and the three sub-pixels in each pixel unit are a red sub-pixel R, a green sub-pixel G and a blue sub-pixel B, respectively; each sub-pixel in a same row is coupled to a same gate line Gate, and each sub-pixel in a same column is coupled to a same data line (the data line coupled with red sub-pixels R in a same column is Data11, the data line coupled with green sub-pixels G in a same column is Data12, and the data line coupled with the blue sub-pixels B in a same column is Data 13); a gate scan signal of any one gate line Gate is provided by one stage of first shift register (for example, FIG. 1 illustrates six stages of first shift registers, i.e., GOA1-1 to GOA1-6, and GOA1-1 provides the gate scan signal for the first gate line Gate).

Figure 5:
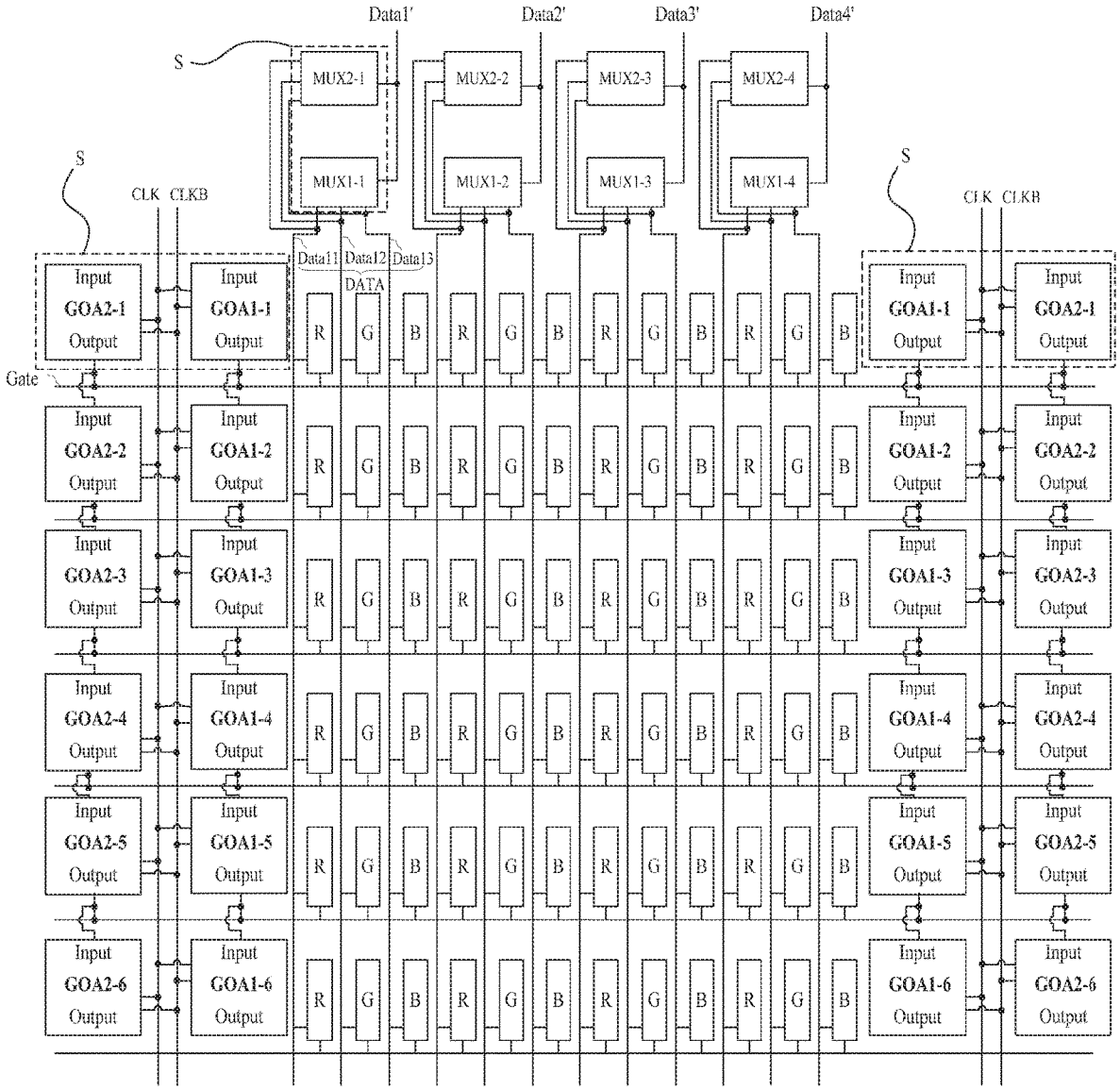
FIG. 5 is a schematic diagram of a display substrate according to an embodiment of the present disclosure.

As shown in FIG. 5, taking dual-side driving as an example, that is, each gate line Gate is coupled to two first shift registers. Specifically, the two first shift registers coupled to each gate line Gate may be coupled to two ends of the gate line Gate, respectively (e.g., each of left and right ends of the first gate line Gate is coupled to one GOA1-1); of course, the first shift register may be coupled to a middle position or any other position of the gate line Gate. compared with single-side driving, i.e., an embodiment in which one gate line Gate is coupled to only one first shift register, in the embodiment of the present disclosure, due to the use of the dual-side driving, the whole signal line for receiving signals can have more uniform voltages at all positions, and the situation that a voltage difference between the signal received at one end close to the shift register and the signal received at one end away from the shift register exists due to the line resistance of the signal line can be alleviated. Each column of pixel units is correspondingly coupled with one data line group DATA, each data line group DATA includes three data lines (Data 11, Data12, and Data 13), each data line group DATA is coupled with one first data selector, and different data line groups DATA are coupled with different first data selectors (i.e., MUX1-1 to MUX1-4 shown in FIG. 1, three data lines coupled with three columns of sub-pixels in the first column of pixel units are coupled with MUX1-1, and three data lines coupled with three columns of sub-pixels in the second column of pixel units are coupled with MUX1-2), and in this case, data voltage signals may be provided through each first data selector to the data lines Data coupled with the first data selector. The first shift registers are coupled together in a cascade mode. Specifically, except the last stages of first shift registers, a signal output terminal Output of the N-th stage of first shift register is coupled with a signal input terminal Input of the (N+1)-th stage of first shift register, where N is an integer greater than or equal to 1. For example: the signal output terminal Output of the first stage of first shift register GOA1-1 shown in FIG. 1 is coupled to the signal input terminal Input of the second stage of first shift register GOA1-2.

Thereinafter, structures of the sub-pixel, the first shift register, and the first data selector will be described.

Transistors used in embodiments of the present disclosure may be thin film transistors or field effect transistors or other devices with the same characteristics, and since a source electrode and a drain electrode of the used transistor are symmetrical, there is no difference between the source electrode and the drain electrode. In the embodiments of the present disclosure, to distinguish the source electrode and the drain electrode of the transistor, one electrode is referred to as a first electrode, the other electrode is referred to as a second electrode, and a gate is referred to as a control electrode. In addition, transistors may be divided into N type transistors and P type transistors according to the characteristics of the transistors. In a case of adopting a P type transistor, the first electrode is the source electrode of the P type transistor, the second electrode is the drain electrode of the P type transistor, and when the gate electrode is applied with a low level, the source electrode and the drain electrode are conducted. In a case of adopting a N type transistor, the first electrode is the source electrode of the N type transistor, the second electrode is the drain electrode of the N type transistor, and when the gate electrode is applied with a high level, the source electrode and the drain electrode are conducted. N-type transistors are taken as examples of transistors in the pixel circuit and the first data selector described below, but it is appreciated that the implementation using P-type transistors can be conceived by those skilled in the art without creative efforts, and therefore is within the protection scope of the embodiments of the present disclosure; P-type transistors are taken as examples of transistors in the first shift register described below, and it is appreciated that the implementation using N-type transistors can be conceived by those skilled in the art without creative efforts, and therefore is within the protection scope of the embodiments of the present disclosure.

For each transistor adopting an N-type transistor, its working level signal terminal is a high level signal terminal VGH, and its non-working level signal terminal is a low level signal terminal VGL. For each transistor adopting a P-type transistor, its working level signal terminal is a low level signal end VGL, and its non-working level signal terminal is a high level signal terminal VGH.

Figure 2:
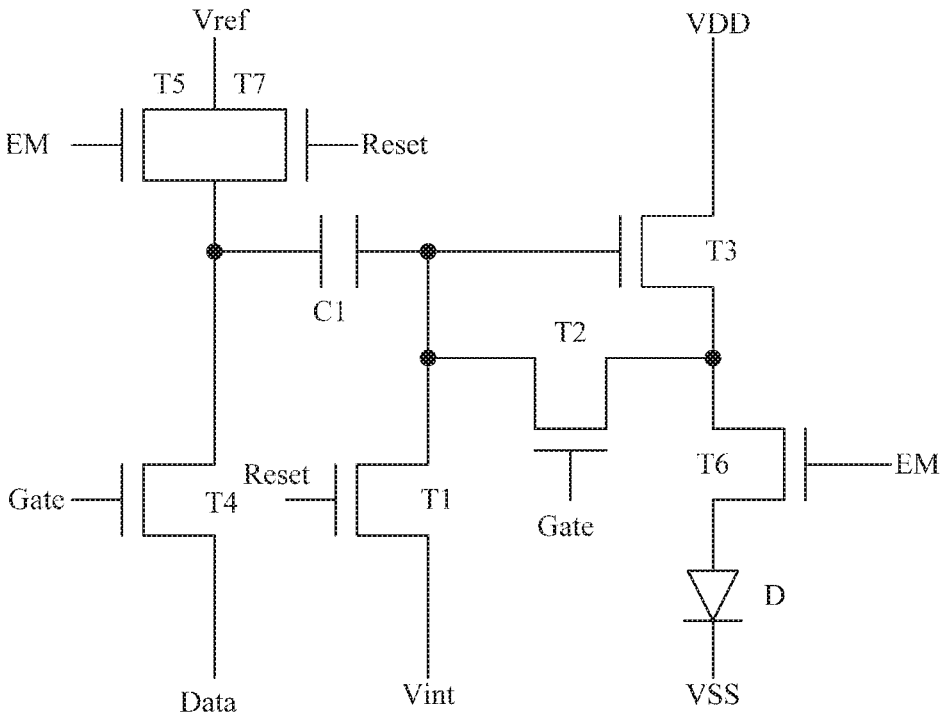
FIG. 2 is a diagram of a pixel circuit in a sub-pixel.

Each sub-pixel at least includes a pixel circuit therein; as shown in FIG. 2, an exemplary pixel circuit is provided, and includes: a first transistor T1, a second transistor T2, a third transistor T3, a fourth transistor T4, a fifth transistor T5, a sixth transistor T6, a seventh transistor T7, a first storage capacitor C1, and a light emitting device D. A first electrode of the first transistor T1 is coupled to an initial voltage signal terminal Vint, a second electrode of the first transistor T1 is coupled to a second terminal of the first storage capacitor C1, a first electrode of the second transistor T2 and a control electrode of the third transistor T3, and a control electrode of the first transistor T1 is coupled to a reset signal terminal Reset. A second electrode of the second transistor T2 is coupled to a second electrode of the third transistor T3 and a first electrode of the sixth transistor T6, and a control electrode of the second transistor T2 is coupled to a gate line Gate. A first electrode of the third transistor T3 is coupled to a first power supply voltage terminal VDD. A first electrode of the fourth transistor T4 is coupled to a data line Data, and a second electrode of the fourth transistor T4 is coupled to a second electrode of the fifth transistor T5, a second electrode of the seventh transistor T7 and a first terminal of the first storage capacitor C1; a control electrode of the fourth transistor T4 is coupled to the gate line. A first electrode of the fifth transistor T5 is coupled to a reference voltage signal terminal Vref, and a control electrode of the fifth transistor T5 is coupled to an emission control line EM. A second electrode of the sixth transistor T6 is coupled to a first electrode of the light emitting device D, and a control electrode of the sixth transistor T6 is coupled to the emission control line EM. A first electrode of the seventh transistor T7 is coupled to the reference voltage signal terminal Vref, a control electrode of the seventh transistor T7 is coupled to the reset signal terminal Reset, and a second electrode of the light emitting device is coupled to a second power supply voltage terminal VSS.

The light emitting device D may be an electric current type light emitting diode, and further may be an electric current type inorganic light emitting diode, such as a micro light emitting diode (Micro LED) or a mini light emitting diode (Mini LED), and of course, the light emitting device D in the embodiments of the present disclosure may also be an organic light emitting diode (OLED). One of the first and second electrodes of the light emitting device D is an anode and the other is a cathode.

It should be noted that, in a case where the light emitting device D is a micro inorganic light emitting diode, the third transistor has a larger channel width-to-length ratio than that in a case where the light emitting device D is an OLED, so as to meet driving requirement of the micro inorganic light emitting diode.

Figure 3:
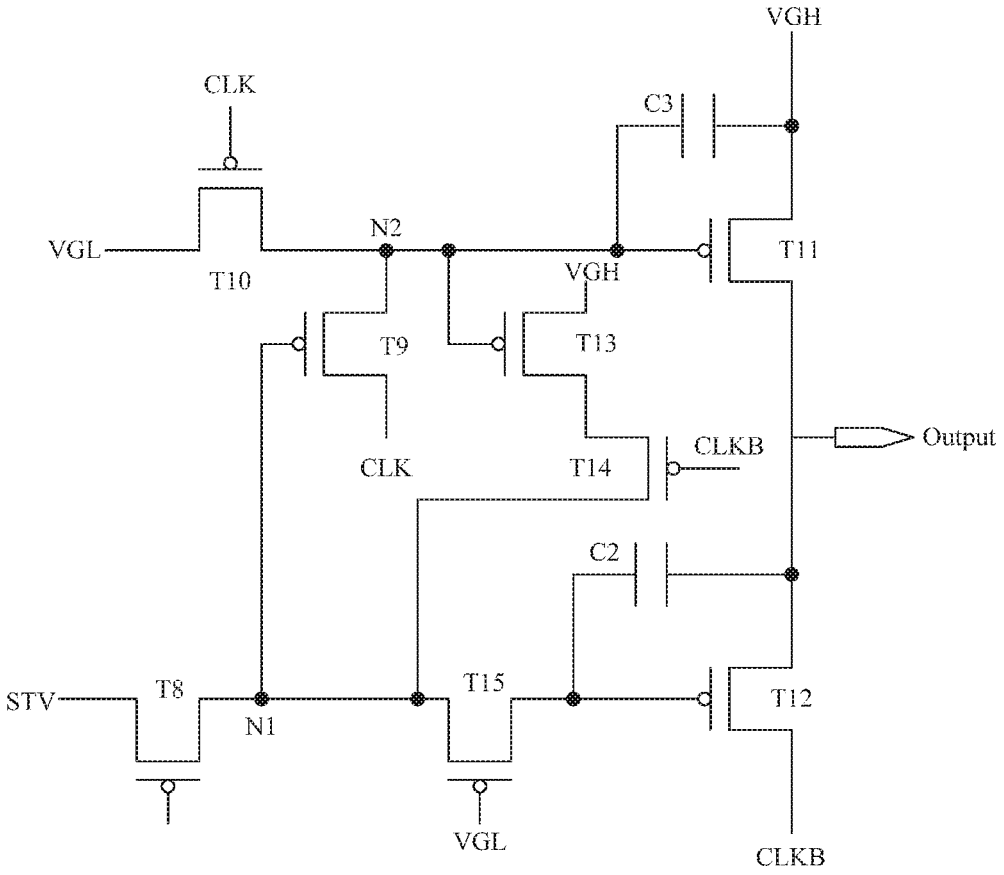
FIG. 3 is a circuit diagram of a first shift register.

As illustrated in FIG. 3, an exemplary first shift register is provided, and includes: an eighth transistor T8, a ninth transistor T9, a tenth transistor T10, an eleventh transistor T11, a twelfth transistor T12, a thirteenth transistor T13, a fourteenth transistor T14, a second storage capacitor C2, and a third storage capacitor C3. A first electrode of the eighth transistor T8 is coupled to a signal input terminal Input, a second electrode of the eighth transistor T8 is coupled to a node N1, and a control electrode of the eighth transistor T8 is coupled to a first clock signal terminal. A first electrode of the ninth transistor T9 is coupled to the first clock signal terminal CLK, a second electrode of the ninth transistor T9 is coupled to a node N2, and a control electrode of the ninth transistor T9 is coupled to the node N1. A first electrode of the tenth transistor T10 is coupled to a low level signal terminal VGL, a second electrode of the tenth transistor T10 is coupled to the node N2, and a control electrode of the tenth transistor T10 is coupled to the first clock signal terminal CLK. A first electrode of the eleventh transistor T11 is coupled to a high level signal terminal VGH and a second terminal of the third storage capacitor C3, a second electrode of the eleventh transistor T11 is coupled to a signal output terminal Output, and a control electrode of the eleventh transistor T11 is coupled to the node N2. A first terminal of the third storage capacitor C3 is coupled to the node N2. A first electrode of the twelfth transistor T12 is coupled to a second clock signal terminal CLKB, a second electrode of the twelfth transistor T12 is coupled to a second terminal of the second storage capacitor C2 and the signal output terminal Output, and a control electrode of the twelfth transistor T12 is coupled to a first terminal of the second storage capacitor C2. A first electrode of the thirteenth transistor T13 is coupled to the high level signal terminal VGH, a second electrode of the thirteenth transistor T13 is coupled to a first electrode of the fourteenth transistor T14, and a control electrode of the thirteenth transistor T13 is coupled to the node N2. A second electrode of the fourteenth transistor T14 is coupled to the node N1, and a control electrode of the fourteenth transistor T14 is coupled to the second clock signal terminal. A first electrode of the fifteenth transistor T15 is coupled to the node N1, a second electrode of the fifteenth transistor T15 is coupled to the first terminal of the second storage capacitor C2, and a control electrode of the fifteenth transistor T15 is coupled to the low level terminal VGL.

Figure 4:
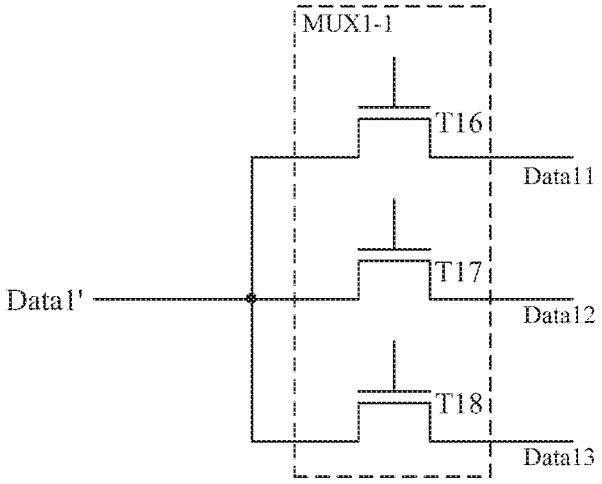
FIG. 4 is a circuit diagram of a first data selector.

As shown in FIG. 4, an exemplary first data selector is provided, and is suitable for a display substrate having a pixel unit including three sub-pixels of a red sub-pixel R, a green sub-pixel G, and a blue sub-pixel B. In the pixel unit, the red sub-pixel is coupled with a data line Data11, the green sub-pixel is coupled with a data line Data12, and the blue sub-pixel is coupled with a data line Datat13. Correspondingly, in an embodiment of the present disclosure, the first data selector includes: a sixteenth transistor T16, a seventeenth transistor T17, and an eighteenth transistor T18. A first electrode of the sixteenth transistor T16, a first electrode of the seventeenth transistor T17 and a first electrode of the eighteenth transistor T18 are coupled together, and are coupled to a source driver (not shown) through a data voltage introduction line Data'; a second electrode of the sixteenth transistor T16 is coupled to the data line Data11, and a control electrode of the sixteenth transistor T16 is coupled to a first output terminal of a timing controller (not shown); a second electrode of the seventeenth transistor T17 is coupled to the data line Data12, and a control electrode of the seventeenth transistor T17 is coupled to a second output terminal of the timing controller; a second electrode of the eighteenth transistor T18 is coupled to the data line Data13, and a control electrode of the eighteenth transistor T18 is coupled to a third output terminal of the timing controller.

Specifically, one of the sixteenth transistor T16, the seventeenth transistor T17 and the eighteenth transistor T18 is controlled to be turned on through a timing signal output from the timing controller (not shown). When the timing controller controls the sixteenth transistor T16 to be turned on, a data voltage supplied by the source driver is supplied to the data line Data11 coupled to the sixteenth transistor T16 through the data voltage introduction line (four data voltage introduction lines, i.e., Data1', Data2', Data3', Data 4', are illustrated in FIG. 1). Similarly, when the timing controller controls the seventeenth transistor T17 to be turned on, a data voltage supplied from the source driver is supplied to the data line Data12 coupled to the seventeenth transistor T17 through the data voltage introduction line Data'. When the timing controller controls the eighteenth transistor T18 to be turned on, a data voltage supplied from the source driver is supplied to the data line Data13 coupled to the eighteenth transistor T18 through the data voltage introduction line Data'.

According to the above description of the structures of the parts of the display substrate, it can be seen that the structure of the display substrate with micro inorganic light emitting diodes is complicated, so that during manufacturing, the process is more complicated compared with manufacturing processes of a traditional liquid crystal display substrate and a traditional OLED display substrate, and thus, accumulation of electrostatic charges occurs in the manufacturing process. As a result, the channel of a transistor in the display substrate is broken down, and particularly, after the transistor in the pixel circuit is broken down, display of the display panel may have a point defect, line defect or area defect.

It should be further noted that, in a display substrate provided in the embodiments of the present disclosure, a signal supply circuit and a redundant signal supply circuit may have a same structure, or may have different circuit structures that implement a same function. In this way, when the signal supply circuit fails, the redundant signal supply circuit may supply the same signal to a pixel unit in the display substrate, and the signal supply circuit and the redundant signal supply circuit adopt the same structure, which facilitates the manufacturing of the display substrate. Of course, the signal supply circuit and the redundant signal supply circuit may have different structures, and in this case, the redundant signal supply circuit and the signal supply circuit need to have a same function. For convenience of understanding, the following embodiments will be described by taking a case where the signal supply circuit and the redundant signal supply circuit adopt a same structure.

In a first aspect, an embodiment of the present disclosure provides a display substrate, which includes a base substrate, and a pixel unit, a signal line, and a signal supply module that are disposed on the base substrate. In particular, in the embodiment of the present disclosure, each signal supply module S includes a signal supply circuit and a redundant signal supply circuit; the signal supply circuit and the redundant signal supply circuit of each signal supply module S are electrically coupled to at least one of a plurality of pixel units through at least one of a plurality of signal lines. That is, each signal supply module S is configured to supply a signal to a pixel unit to which a signal line coupled thereto is coupled.

Since the signal supply module S of the display substrate is provided with the redundant signal supply circuit in the embodiment of the present disclosure, even if one of the signal supply circuit and the corresponding redundant signal supply circuit is damaged due to electrostatic charge accumulation in the manufacturing process of the display panel, the other one can supply a corresponding signal to the signal line in the display substrate so as to ensure normal operation of the display substrate.

It should be noted that, the numbers of the signal supply circuit and the redundant signal supply circuit in each signal supply module S are both one. Of course, each signal supply module S may be correspondingly provided with one signal supply circuit and a plurality of redundant signal supply circuits. The embodiments of the present disclosure are described by taking a case where the signal supply circuit and the redundant signal supply circuit in the signal supply module S are provided in pairs, that is, the signal supply module S includes one signal supply circuit and one redundant signal supply circuit as an example. Before using the display substrate to form a display panel, the circuit structure that fails in each signal supply module S needs to be electrically disconnected with other electrical structures in the display substrate through a laser cutting process. Specifically, a connection line between an output terminal of the circuit structure that fails and the signal line(s) may be cut off, so that the circuit structure that fails is prevented from outputting an error signal to the signal line(s). Of course, if neither the signal supply circuit nor the redundant signal supply circuit in the signal supply module S fails, any one of the signal supply circuit and the redundant signal supply circuit in the signal supply modules S is electrically disconnected from the other electrical structure(s) in the display substrate to reduce the load of the display substrate.

In some embodiments, as shown in FIG. 5, the signal lines may be gate lines Gate, the signal supply circuits in the signal supply modules S may be first shift registers (six first shift registers, i.e., GOA1-1 to GOA1-6 shown in FIG. 5), and the redundant signal supply circuits may include six second shift registers (six second shift registers, i.e., GOA2-1 to GOA2-6 shown in FIG. 5) having the same structure as the first sift registers. The first shift register and the second shift register in each signal supply module S are coupled to a same gate line Gate, and are configured to provide a gate scan signal to pixel units coupled to the gate line Gate.

The structures of the first shift register and the second shift register are the same as those of the above-described first shift register, and therefore, descriptions thereof are not repeated. It should be understood that the signal input terminal Input, the first clock signal terminal CLK, the second clock signal terminal CLKB, the high level signal terminal VGH, and the low level signal terminal VGL coupled to the second shift register are respectively the same as the signal input terminal Input, the first clock signal terminal CLK, the second clock signal terminal CLKB, the high level signal terminal VGH, and the low level signal terminal VGL of the first shift register corresponding thereto.

In some embodiments, the display substrate is a dual-side driving type display substrate, that is, one row of pixel units is driven by two first shift registers, and correspondingly, one row of pixel units corresponds to two second shift registers. Specifically, taking one row of pixel units as an example, the row of pixel units is coupled to one gate line Gate, the signal output terminals of the two first shift registers are respectively coupled to two ends of the gate line Gate, and the signal output terminals of the two second shift registers are also respectively coupled to the two ends of the gate line Gate, that is, the first shift registers and the second shift registers are arranged in a one-to-one correspondence manner. Thus, if one of the first shift register and the second shift register at one end of the gate line Gate is damaged, the gate line Gate may be provided with a gate scan signal through the other one. Of course, in the embodiment of the present disclosure, the two first shift registers may be positioned in a middle area of the display substrate, for example, the first shift register is positioned between two columns of pixel units, and the two first shift registers driving a same gate line are positioned between pixel units of different columns. The position of the first shift register is not limited in any way in the embodiments of the present disclosure.

Specifically, as shown in FIG. 5, all the first shift registers coupled to the left side of the gate lines Gate are connected in cascade, and all the second shift registers connected to the left side of the gate lines Gate are connected in cascade. Similarly, all the first shift registers connected to the right side of the gate lines Gate are connected in cascade; all the second shift register connected to the right side of the gate lines Gate are connected in cascade. Connections of the first shift registers and the second shift registers connected to the left side of the gate lines Gate are described as an example. The signal output terminal of GOA1-1 is coupled to the signal input terminal of GOA1-2; the signal output terminal of GOA1-2 is coupled to the signal input terminal of GOA1-3; the signal output terminal of GOA1-3 is coupled to the signal input terminal of GOA1-4; the signal output terminal of GOA1-4 is coupled to the signal input terminal of GOA1-5; and the signal output terminal of GOA1-5 is coupled to the signal input terminal of GOA1-6. Similarly, the signal output terminal of GOA2-1 is coupled to the signal input terminal of GOA2-2; the signal output terminal of GOA2-2 is coupled to the signal input terminal of GOA2-3; the signal output terminal of GOA2-3 is coupled to the signal input terminal of GOA2-4; the signal output terminal of GOA2-4 is coupled to the signal input terminal of GOA2-5; and the signal output terminal of GOA2-5 is coupled to the signal input terminal of GOA2-6.

In some embodiments, as shown in FIG. 5, the signal lines may be data line groups DATA, each data line group DATA includes a plurality of data lines (e.g., each data line group DATA shown in FIG. 5 includes three data lines Data11, Data12, and Data 13), and is correspondingly connected to one column of pixel units. The signal supply circuit in each signal supply module S may be a first data selector (four first data selectors MUX1-1 to MUX1-4 are shown in FIG. 5), and the redundant signal supply circuit may be a second data selector (four second data selectors MUX2-1 to MUX2-4 are shown in FIG. 5) having the same structure as the first data selector, the first data selectors and the second data selectors are arranged in pairs, that is, one signal supply module S includes one first data selector and one second data selector, and in this case each signal supply module S is configured to provide data voltage signals for the pixel units of a same column.

For convenience of description, taking a case where each column of pixel units includes three columns of sub-pixels of three different colors, namely, red, green and blue as an example, a data line coupled to red sub-pixels in a same column is referred to as a data line Data11, and similarly, a data line coupled to green sub-pixels in a same column is referred to as a data line Data12, and a data line coupled to blue sub-pixels in a same column is referred to as a data line Data13. Hereinafter, the connection relationship between the data line Data11, the data line Data12, and the data line Data13, which are respectively coupled to the three columns of sub-pixels in the first column of pixel units, and the first and second data selectors will be specifically described.

Specifically, as shown in FIG. 5, each column of pixel units includes three columns of sub-pixels of three different colors, which are one column of red sub-pixels R, one column of green sub-pixels G, and one column of blue sub-pixels B, and each data line group DATA includes three data lines, which are Data11, Data12, and Data13. Taking the connection relationship between MUX1-1 and MUX2-1 and the data line group as an example, the input terminals of MUX1-1 and MUX2-1 are coupled to the data voltage introduction line Data', and three output terminals of each of MUX1-1 and MUX2-1 are coupled to data lines Data11, Data12 and Data13, respectively, so that when one of MUX1-1 and MUX2-1 is damaged, the damaged one can be disconnected from the data lines Data11, Data12 and Data13 and from the data voltage introduction lines Data', and data voltage signals can be provided to the three data lines Data11, Data12 and Data13 corresponding to the column of pixel units through the other one.

In some embodiments, each of the first data selector and the second data selector may include the sixteenth transistor T16, the seventeenth transistor T17, and the eighteenth transistor T18, and the connection relationship between each transistor in the second data selector and the source driver, the timing controller, the data line Data11, the data line Data12, and the data line Data13 is the same as that in the first data selector. The connection relationship has already been described above, and is not described in detail here.

In some embodiments, the first data selector and the second data selector are both disposed at a side of the base substrate where the signal input terminals of the data lines Data are located.

Figure 6:
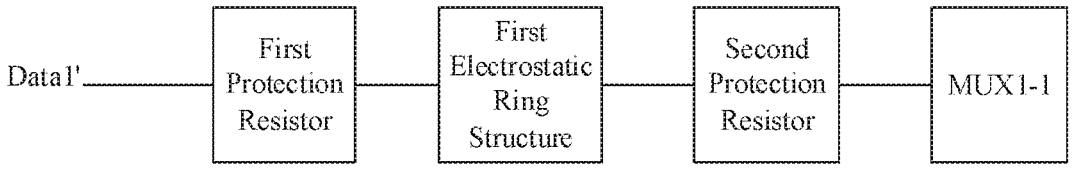
FIG. 6 is a schematic diagram illustrating a position of a first electrostatic ring structure.
Figure 7:
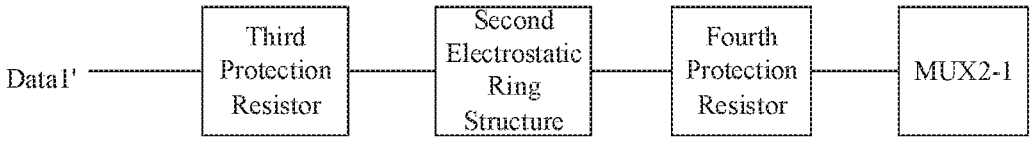
FIG. 7 is a schematic diagram illustrating a position of a second electrostatic ring structure.

In some embodiments, as shown in FIGS. 6 and 7, the display substrate includes not only the above-described structures but also a first electrostatic ring structure coupled between the data voltage introduction line Data' and the first data selector, and a second electrostatic ring structure coupled between the data voltage introduction line Data' and the second data selector; the first electrostatic ring structure and the second electrostatic ring structure may be antistatic structures having a same structure, and are configured to avoid electrostatic breakdown of a channel of a transistor in the display substrate caused by static electricity generated in the process of manufacturing the display substrate.

In some embodiments, as shown in FIGS. 6 and 7, a first protection resistor is coupled between the first electrostatic ring structure and the data voltage introduction line (four data signal introduction lines, which are Data1', Data2', Data3' and Data4', respectively, are illustrated in FIG. 5); a second protection resistor is coupled between the first electrostatic ring structure and the first data selector; a third protection resistor is coupled between the second electrostatic ring structure and the data voltage introduction line; and a fourth protection resistor is coupled between the second electrostatic ring structure and the second data selector. The first protection resistor, the second protection resistor, the third protection resistor and the fourth protection resistor are provided to protect transistors in the pixel unit in the display substrate to a certain extent, and meanwhile, the first electrostatic ring structure and the second electrostatic ring structure cannot be easily electrostatic breakdown, so that the effect of multiple electrostatic protection is achieved.

In some embodiments, each of resistances of the first protection resistor, the second protection resistor, the third protection resistor and the fourth protection resistor is, but not limited to, between 400Ω and 500Ω.

Figure 8:
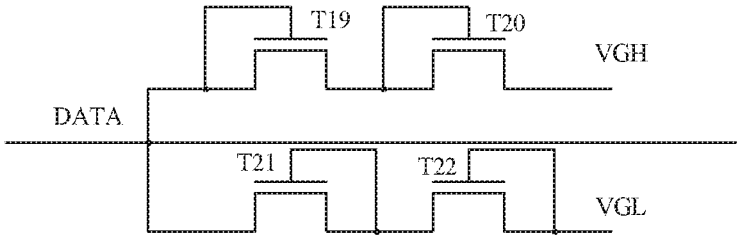
FIG. 8 is a schematic structural diagram of a first electrostatic ring structure.

As shown in FIG. 8, a specific circuit structure of a first electrostatic ring structure (second electrostatic ring structure) is described below. The first electrostatic ring structure includes four transistors, namely, a first electrostatic transistor T19, a second electrostatic transistor T20, a third electrostatic transistor T21 and a fourth electrostatic transistor T22. The first electrostatic transistor T19, the second electrostatic transistor T20, the third electrostatic transistor T21 and the fourth electrostatic transistor T22 may be N-type or P-type transistors; when each transistor is an N-type transistor, the working level signal terminal is a high level signal terminal VGH, and the non-working level signal terminal is a low level signal terminal VGL; when each transistor is a P-type transistor, the working level signal terminal is a low level signal terminal VGL, and the non-working level signal terminal is a high level signal terminal VGH. The working principle of the first electrostatic ring structure will be described below by taking N-type transistors as examples of the first electrostatic transistor T19, the second electrostatic transistor T20, the third electrostatic transistor T21, and the fourth electrostatic transistor T22 in the first electrostatic ring structure.

A first electrode of the first electrostatic transistor T19 is coupled to a control electrode thereof and the data voltage introduction line Data', a second electrode of the first electrostatic transistor T19 is coupled to a first electrode and a control electrode of the second electrostatic transistor T20, and a second electrode of the second electrostatic transistor T20 is coupled to a low level signal terminal VGL; a first electrode of the third electrostatic transistor T21 is coupled to the data voltage introduction line Data1', a second electrode of the third electrostatic transistor T21 is coupled to and a control electrode thereof and a first electrode of the fourth electrostatic transistor T22, and a second electrode of the fourth electrostatic transistor T22 is coupled to a control electrode thereof and a high operation level signal terminal VGH.

When a data introduced to the data voltage introduction line Data1' is a negative high voltage, the first electrostatic transistor T19 and the second electrostatic transistor T20 are turned on, and static electricity is extracted through the low level signal terminal VGL of the branch where the first electrostatic transistor T19 and the second electrostatic transistor T20 are located.

When a data introduced from the data voltage introduction line Data1' is a positive high voltage, the third electrostatic transistor T21 and the fourth electrostatic transistor T22 are turned on, and static electricity is extracted through the high level signal terminal VGH of the branch where the third electrostatic transistor T21 and the fourth electrostatic transistor T22 are located. It should be understood that the voltage value of the positive high voltage in this case should be generally greater than the value of the voltage input by the high level voltage terminal VGH coupled to the second electrode of the fourth electrostatic transistor T22.

The working principle of the second electrostatic ring structure is the same as that of the first electrostatic ring structure, and therefore, the description thereof is omitted.

Figure 9:
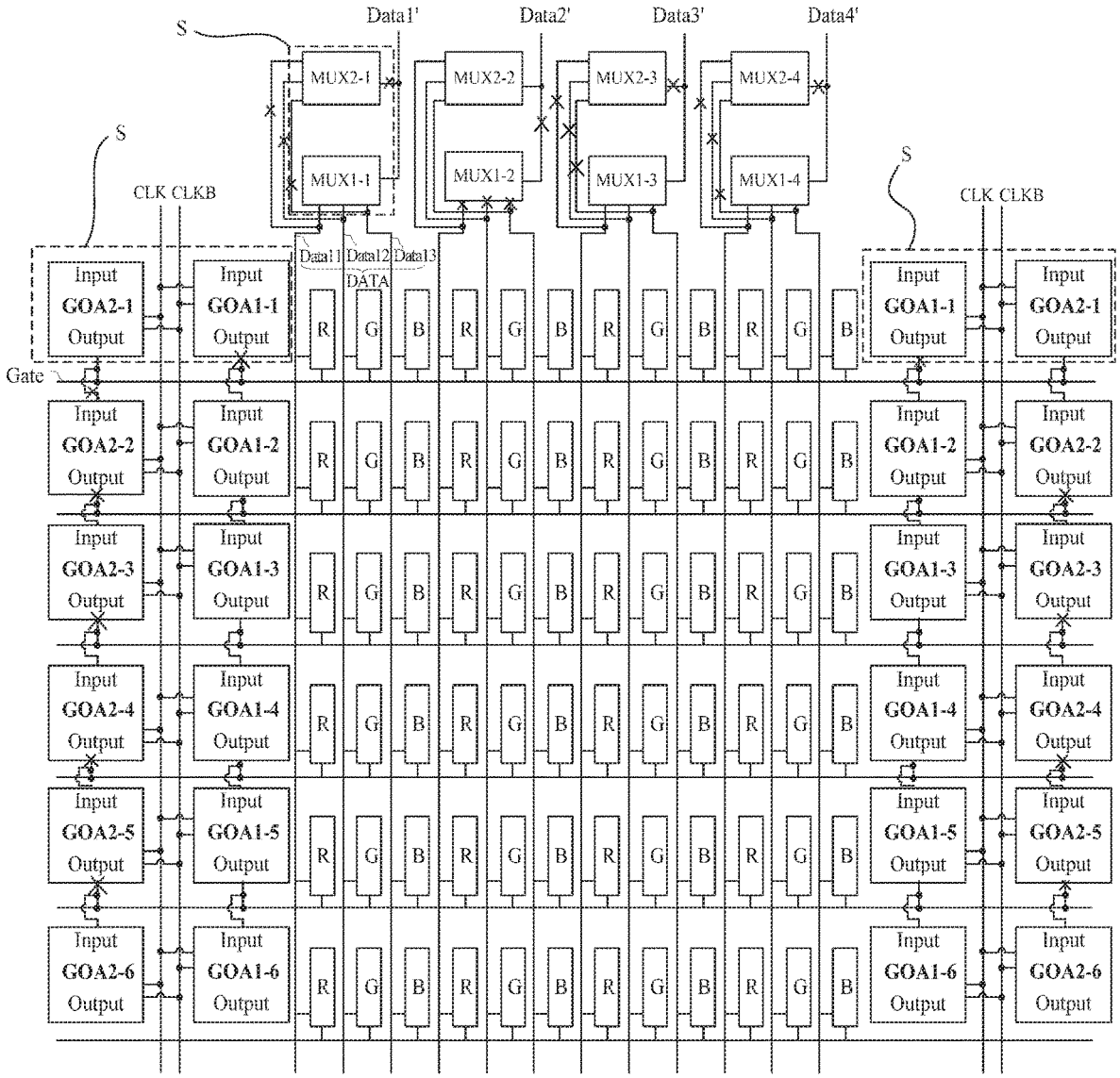
FIG. 9 is a schematic diagram of another display substrate in an embodiment of the present disclosure.

In a second aspect, as shown in FIG. 9, an embodiment of the present disclosure provides a display substrate, the display substrate is formed based on the above display substrate. After the above-described display substrate is subjected to failure detection, a structure that fails in each signal supply module S is electrically disconnected from other structures in the display substrate through a laser cutting process (i.e., a disconnection position for cutting indicated by an "X" in FIG. 9); if neither the signal supply circuit nor the redundant signal supply circuit in any one of the signal supply modules S fails, any one of the signal supply circuit and the redundant signal supply circuit in the signal supply module S is electrically disconnected from the other structures in the display substrate to reduce the load of the display substrate. That is, the display substrate in the embodiment of the present disclosure includes a base substrate; and a plurality of pixel units arranged in an array, a plurality of signal lines and signal supply modules S on the base substrate; the signal supply module S includes: a signal supply circuit and a redundant signal supply circuit; only one of the signal supply circuit and the redundant signal supply circuit of each signal supply module S is electrically coupled to at least one of the plurality of pixel units through at least one of the plurality of signal lines.

According to the display substrate in the present embodiment of the present disclosure, after the above-described display substrate is subjected to failure detection, the circuit structure that fails in each signal supply module S is electrically disconnected from other electrical structures in the display substrate through a laser cutting process; specifically, the connection lines between the output terminal of the circuit structure that fails and the signal lines can be cut off, so as to prevent the circuit structure that fails from outputting an error signal to the signal lines. Of course, if neither the signal supply circuit nor the redundant signal supply circuit in the signal supply module S fails, any one of the signal supply circuit and the redundant signal supply circuit in the signal supply module S is electrically disconnected from other electrical structures in the display substrate, so as to obtain the display substrate in the present embodiment, so that the display substrate in the embodiment of the present disclosure has a higher yield.

In the embodiment of the present disclosure, the signal supply circuit in the signal supply module S may be the first shift register, and in this case the redundant signal supply circuit is the second shift register. Of course, the signal supply circuit in the signal supply module S in the embodiment of the present disclosure may be the first data selector, and in this case, the redundant signal supply circuit may be the second data selector. The first shift register, the second shift register, the first data selector and the second data selector may adopt the same structures as described above, and therefore, the descriptions thereof are not repeated. Other structures of the display substrate according to the embodiment of the present disclosure may also be the same as those of the above-described display substrate, and thus, the descriptions thereof are not repeated.

In a third aspect, an embodiment of the present disclosure further provides a display panel, which includes the display substrate. The display panel may be a liquid crystal display device or an electroluminescent display device, such as a liquid crystal panel, an OLED panel, a MicroLED panel, a MiniLED panel, a mobile phone, a tablet computer, a television, a display, a notebook computer, a digital photo frame, a navigator, and any product or component with a display function.

It could be understood that the above embodiments are merely exemplary embodiments adopted for describing the principle of the present disclosure, but the present disclosure is not limited thereto. Various variations and improvements may be made by those of ordinary skill in the art without departing from the spirit and essence of the present disclosure, and these variations and improvements shall also be regarded as falling into the protection scope of the present disclosure.

What is claimed is:

1. A display substrate, comprising:

a base substrate; and a plurality of pixel units arranged in an array, a plurality of signal lines and signal supply modules on the base substrate;

wherein each of the plurality of pixel units comprises a plurality of sub-pixels;

the plurality of signal lines comprises a plurality of data lines and a plurality of gate lines;

sub-pixels in a same column are coupled with a same data line, and sub-pixels in different columns are coupled with different data lines; sub-pixels in a same row are coupled with a same gate line;

each of the signal supply modules comprises: a signal supply circuit and a redundant signal supply circuit; and each of the signal supply modules is electrically coupled, through at least one of the plurality of data lines and the plurality of gate lines, to at least one column or at least one row of sub-pixels coupled with the at least one of the plurality of data lines and the plurality of gate lines.

2. The display substrate of claim 1, wherein the signal supply circuit and the redundant signal supply circuit of each of the signal supply modules are electrically coupled to at least one of the plurality of pixel units through at least one of the plurality of signal lines.

3. The display substrate of claim 1, wherein the plurality of data lines form data line groups, and each of the data line groups comprises a plurality of data lines; pixel units in a same column are coupled with a same data line group;

the signal supply modules and the data line groups are in one-to-one correspondence;

the signal supply circuit comprises: a first data selector; the redundant signal supply circuit comprises: a second data selector; and the first data selector and the second data selector of each of the signal supply modules are electrically coupled to pixel units through the data line group corresponding thereto.

4. The display substrate of claim 3, further comprising: a data voltage introduction line, a first electrostatic ring structure and a second electrostatic ring structure; wherein the data voltage introduction line is coupled with the first data selector through the first electrostatic ring structure; a first protection resistor is coupled between the data voltage introduction line and the first electrostatic ring structure; a second protection resistor is coupled between the first electrostatic ring structure and the first data selector; and the data voltage introduction line is coupled with the second data selector through the second electrostatic ring structure; a third protection resistor is coupled between the data voltage introduction line and the second electrostatic ring structure; a fourth protection resistor is coupled between the second electrostatic ring structure and the second data selector.

5. The display substrate of claim 4, wherein each of the first electrostatic ring structure and the second electrostatic ring structure comprises a first electrostatic transistor, a second electrostatic transistor, a third electrostatic transistor and a fourth electrostatic transistor;

a first electrode of the first electrostatic transistor is coupled with a control electrode thereof and the data voltage introduction line, a second electrode of the first electrostatic transistor is coupled with a first electrode and a control electrode of the second electrostatic transistor, and a second electrode of the second electrostatic transistor is coupled with a non-working level signal terminal; and a first electrode of the third electrostatic transistor is coupled with the data voltage introduction line, a second electrode of the third electrostatic transistor is coupled with a control electrode thereof and a first electrode of the fourth electrostatic transistor, and a second electrode of the fourth electrostatic transistor is coupled with a control electrode thereof and a working level signal terminal.

6. The display substrate of claim 4, wherein resistance values of the first protection resistor, the second protection resistor, the third protection resistor and the fourth protection resistor are all between 400Ω and 500 Ω.

7. The display substrate of claim 3, wherein the pixel unit comprises three sub-pixels; the data line group comprises three data lines.

8. The display substrate of claim 3, wherein the first data selector and the second data selector are on a side of the base substrate where signal input terminals of the data lines are located.

9. The display substrate of claim 1, wherein the signal supply circuit of each of the signal supply modules comprises a first shift register, and the redundant signal supply circuit comprises a second shift register; the first shift register and the second shift register are arranged in pairs and coupled to a same gate line; and the gate line is coupled with the first shift register and the second shift register in pairs in at least one of the signal supply modules.

10. The display substrate of claim 9, wherein the gate line is coupled with two signal supply modules, and the two signal supply modules are coupled to two opposite ends of the gate line, respectively.

11. The display substrate of claim 9, wherein in the signal supply modules, a plurality of first shift registers are coupled in cascade, and a plurality of second shift registers are coupled in cascade; stages of first shift registers are respectively coupled with different gate lines; stages of second shift registers are respectively coupled with different gate lines;

a signal input terminal of an N-th stage of first shift register is coupled with a signal output terminal of an (N−1)-th stage of first shift register; a signal output terminal of the N-th stage of first shift register is coupled with a signal input terminal of an (N+1)-th stage of first shift register; and a signal input terminal of an N-th stage of second shift register is coupled with a signal output terminal of an (N−1)-th stage of second shift register; a signal output terminal of the N-th stage of second shift register is coupled with a signal input terminal of an (N+1)-th stage of second shift register, where N is an integer greater than 1.

12. The display substrate of claim 1, wherein only one of the signal supply circuit and the redundant signal supply circuit of each of the signal supply modules is electrically coupled, through the at least one of the plurality of data lines and the plurality of gate lines, to at least one column or at least one row of sub-pixels coupled with the at least one of the plurality of data lines and the plurality of gate lines.

13. The display substrate of claim 12, wherein the plurality of data lines form data line groups, and each of the data line groups comprises a plurality of data lines; pixel units in a same column are coupled with a same data line group;

the signal supply modules and the data line groups are in one-to-one correspondence;

the signal supply circuit comprises: a first data selector; the redundant signal supply circuit comprises: a second data selector; and only one of the first data selector and the second data selector of each of the signal supply modules is electrically coupled to the pixel units through the data line group corresponding thereto.

14. The display substrate of claim 13, further comprising: a data voltage introduction line, a first electrostatic ring structure and a second electrostatic ring structure;

wherein the data voltage introduction line is coupled with the first data selector through the first electrostatic ring structure; a first protection resistor is coupled between the data voltage introduction line and the first electrostatic ring structure; a second protection resistor is coupled between the first electrostatic ring structure and the first data selector; and the data voltage introduction line is coupled with the second data selector through the second electrostatic ring structure; a third protection resistor is coupled between the data voltage introduction line and the second electrostatic ring structure; a fourth protection resistor is coupled between the second electrostatic ring structure and the second data selector.

15. The display substrate of claim 14, wherein each of the first electrostatic ring structure and the second electrostatic ring structure comprises a first electrostatic transistor, a second electrostatic transistor, a third electrostatic transistor and a fourth electrostatic transistor;

a first electrode of the first electrostatic transistor is coupled with a control electrode thereof and the data voltage introduction line, a second electrode of the first electrostatic transistor is coupled with a first electrode and a control electrode of the second electrostatic transistor, and a second electrode of the second electrostatic transistor is coupled with a non-working level signal terminal; and a first electrode of the third electrostatic transistor is coupled with the data voltage introduction line, a second electrode of the third electrostatic transistor is coupled with a control electrode thereof and a first electrode of the fourth electrostatic transistor, and a second electrode of the fourth electrostatic transistor is coupled with a control electrode thereof and a working level signal terminal.

16. The display substrate of claim 13, wherein the first data selector and the second data selector are on a side of the base substrate where signal input terminals of the data lines are located.

17. The display substrate of claim 12, wherein the signal lines comprise gate lines; pixel units in a same row are coupled with a same gate line; the signal supply circuit of each of the signal supply modules comprises a first shift register, and the redundant signal supply circuit comprises a second shift register; the first shift register and the second shift register are arranged in pairs and correspond to a same gate line; and the gate line is coupled with only one of the first shift register and the second shift register in pairs in at least one of the signal supply modules.

18. The display substrate of claim 17, wherein the gate line is coupled with two signal supply modules, and the two signal supply modules are coupled to two opposite ends of the gate line, respectively.

19. The display substrate of claim 17, wherein in the signal supply modules, a plurality of first shift registers are coupled in cascade, and a plurality of second shift registers are coupled in cascade; stages of first shift registers are respectively coupled with different gate lines; stages of second shift registers are respectively coupled with different gate lines;

a signal input terminal of an N-th stage of first shift register is coupled with a signal output terminal of an (N−1)-th stage of first shift register; a signal output terminal of the N-th stage of first shift register is coupled with a signal input terminal of an (N+1)-th stage of first shift register; and a signal input terminal of an N-th stage of second shift register is coupled with a signal output terminal of an (N−1)-th stage of second shift register; a signal output terminal of the N-th stage of second shift register is coupled with a signal input terminal of an (N+1)-th stage of second shift register.

20. A display panel, comprising the display substrate of claim 1.

* * * * *